US006709085B2

(12) United States Patent
Hoshino et al.

(10) Patent No.: US 6,709,085 B2
(45) Date of Patent: Mar. 23, 2004

(54) SCANNING PRINTING APPARATUS AND PRINTING METHOD USED THEREIN

(75) Inventors: Takashi Hoshino, Kanagawa (JP); Toshiya Kojima, Kanagawa (JP); Seiichi Inoue, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/305,159

(22) Filed: Nov. 27, 2002

(65) Prior Publication Data

US 2003/0098897 A1 May 29, 2003

(30) Foreign Application Priority Data

Nov. 28, 2001 (JP) ..... 2001-362365

(51) Int. Cl.[7] ..... B41J 29/393
(52) U.S. Cl. ..... 347/19; 347/37
(58) Field of Search ..... 346/23; 347/19, 347/37, 98, 109; 400/88; 235/468

(56) References Cited

U.S. PATENT DOCUMENTS 3,735,350 A * 5/1973 Lemelson ..... 235/472.03
4,740,802 A * 4/1988 Stuckey-Kauffman et al. ..... 347/115
4,789,874 A * 12/1988 Majette et al. ..... 347/37
5,069,556 A * 12/1991 Sasaki et al. ..... 400/74
5,446,559 A * 8/1995 Birk ..... 358/473
5,600,350 A * 2/1997 Cobbs et al. ..... 347/19
5,927,872 A * 7/1999 Yamada ..... 400/88
5,980,016 A * 11/1999 Nelson et al. ..... 347/19
6,312,082 B1 * 11/2001 Lund et al. ..... 347/19
6,517,266 B2 * 2/2003 Saund ..... 400/88

FOREIGN PATENT DOCUMENTS

EP 953 454 A2 * 11/1999 ..... B41J/3/407
JP 09-267522 A 10/1997
JP 09-300727 A 11/1997
JP 10-035032 A 2/1998

* cited by examiner

*Primary Examiner*—Juanita Stephens
*Assistant Examiner*—Blaise L Mouttet
(74) *Attorney, Agent, or Firm*—Sughrue Mion, PLLC

(57) ABSTRACT

The scanning printing apparatus prints an image composed of a plurality of row images in accordance with image signals and each row images is printed while moving in a direction on a recording medium. The apparatus includes a moving unit for moving the apparatus itself on the medium in the one direction, a first ejection head for printing each row image of the image on the medium, a second ejection head for printing predetermined invisible marks which cannot be identified by humans on the medium, a first sensor for detecting the invisible marks printed on the medium and a control unit for controlling the moving unit based on detection results of the first sensor. The printing method prints the image by using the apparatus while correcting a printing position based on a position of the detected invisible marks.

12 Claims, 9 Drawing Sheets

SCANNING PRINTING APPARATUS AND PRINTING METHOD USED THEREIN

BACKGROUND OF THE INVENTION

1. Field of the Invention

The present invention relates to a scanning printing apparatus or a self-propelled type printing apparatus which performs printing onto a recording medium by scanning its main body provided with a printing means, and to a method of printing using the scanning printing apparatus. In particular, the present invention relates to a scanning printing apparatus capable of easily printing an image composed of a plurality of row images using an ink jet recording method, and to a method of printing using the scanning printing apparatus.

2. Description of the Related Art

Up to now, various proposals have been made for scanning printing apparatuses for printing an image onto a recording medium such as paper with manual scanning of its main body prepared with a printing means (JP 9-267522 A, JP 9-300727 A, JP 10-35029 A, JP 10-35032 A, JP 8-1096 U, and the like).

A manual scanning printing apparatus disclosed in JP 9-267522 A is a printing apparatus for printing capital letters over a plurality of row images by a plurality of scanning operations, and a dot position detecting circuit (printing position detecting means) for detecting the dot printing position of the previous row image is formed. The printing position of the dots of the row image prior to the row image to be currently printed is thus detected. Printing timing is then corrected based on a detection signal, and further, a shifting amount for character data is determined, the character data is shifted, a character pattern is set, and printing is performed.

With a manual scanning printing apparatus disclosed in JP 9-300727 A, a break point detecting means for detecting whether or not a print head printing position is in a break point position for the current character data, and an informing means which turns off a light emitting device when the printing head printing position is in the break point position for the character data (blank position between characters) are formed. After the reception of a signal from the detecting means, the light emitting device is turned on when the printing position of the print head is the character position of the current printing data. A user can thus know that the print head is currently in the blank position between characters when the light emitting device is turned off. A linefeed may thus be performed when the light emitting device is turned off, and therefore the linefeed can be accomplished easily and the character to be printed can be printed without segmentation.

Three position signal generator devices are disposed in a manual scanning printing apparatus disclosed in JP 10-35029 A, and each position signal generated from the position signal generator devices is received by a signal receiver of a main body portion. The current position of the main body portion is detected based on the phase difference in each of the position signals, data corresponding to a two-dimensional position is received, and printing is performed. The position of the main body portion can thus be accurately detected, printing operations can be accurately performed, and therefore very good printing results can be obtained.

In a manual scanning printing apparatus disclosed in JP 10-35032 A, the amount of shift with respect to the printing direction of the apparatus is detected based upon the difference in rotational speed of left and right rollers, and the printing position of a recording head is corrected based upon the amount of shift. Good printing results can thus be obtained even if there are no guides, such as ruled lines, on the recording medium.

A manual scanning printing apparatus disclosed in JP 8-1096 U has a movable housing, a print head is formed within the movable housing, and a printing surface of the print head protrudes from an opening portion formed in a bottom wall portion. A rotatable spindle is formed in the bottom wall portion of the movable housing, and a pair of rollers are attached to the spindle. Further, a supplemental roller is rotatably formed in a position away from the spindle. In addition, a display lamp is provided which is turned off when a linefeed code is sent as printing data. A predetermined character pattern is formed in the print head by the printing data, and the character pattern is transferred to the surface of the recording medium by an ink donor film disposed on the print head. Further, an operator can verify that the linefeed code has been sent, and therefore whether or not printing is performed on the same row image can be appropriately selected.

However, there is a problem with these conventional techniques in that an image cannot be easily printed over a plurality of row images. Further, another problem is that manual scanning in a straight line is difficult to be performed.

SUMMARY OF THE INVENTION

In order to solve the problems with the conventional techniques, an object of the present invention is to provide a scanning printing apparatus capable of easily printing an image composed of a plurality of row images with good image quality.

Another object of the present invention is to provide a method of printing using the scanning printing apparatus.

The invention provides a scanning printing apparatus for printing an image composed of a plurality of row images, in accordance with image signals, each row image being printed while moving in one direction or its opposite direction on a recording medium, comprising: moving means for moving the scanning printing apparatus itself on the recording medium in the one direction or its opposite direction; a first ejection head for printing each row image of the image on the recording medium, having: a plurality of nozzles for ejecting ink, disposed in another direction orthogonal to the one direction; and an ink ejecting means disposed corresponding to the plurality of nozzles and modulated and driven in accordance with the image signals; a second ejection head for printing predetermined invisible marks which cannot be identified by humans on the recording medium; a first sensor for detecting the predetermined invisible marks which have been printed on the recording medium; and control means for controlling the moving means based on detection results of the first sensor.

It is preferable that the second ejection head prints an invisible straight line, which cannot be identified by humans, as the predetermined invisible marks along the one direction or its opposite direction from a side further upstream than a portion at which a region printed by the first ejection head begins; the first sensor detects position of the invisible straight line in the other direction; and the control means controls the moving means so that the position of the invisible straight line in the other direction, which is detected by the first sensor, is held within a predetermined range.

The scanning printing apparatus may further comprises a third ejection head for printing on the recording medium other predetermined invisible marks which cannot be identified by humans and which extend in the other direction and at least, further upstream in the one direction or its opposite direction than the first ejection head; and a second sensor for detecting the other predetermined invisible marks which have been printed on the recording medium by the third ejection head.

It is also preferable that the control means has determining means for determining whether a position of the first ejection head is suitable for printing or not, and the apparatus further comprising: warning generating means for generating a predetermined warning when the determining means determines based on the detection results of the first sensor, that the position of the first ejection head is not suitable for printing.

It is still also preferable that control means has determining means for determining whether a position of the first ejection head is suitable for printing or not, and the control means controls the moving means to correct the position of the first ejection head so as to be suitable for printing when the determining means determines based on the detection results of the first sensor, that the position of the first ejection head is not suitable.

The scanning printing apparatus may further comprises a storage unit for storing image signals for the image composed of the plurality of row images which is printed on the recording medium.

The invention also provides a method of printing an image composed of a plurality of row images in accordance with image signals on a recording medium by using a scanning printing apparatus having moving means for moving the scanning printing apparatus itself on the recording medium in one direction or its opposite direction, the apparatus printing each row image of the image while moving in the one direction or its opposite direction on the recording medium, comprising: printing predetermined invisible marks which cannot be identified by humans, while printing each row image of the image composed of the plurality of row images; detecting the predetermined invisible marks that have been printed in a previous row image in printing of each row image; and correcting a printing position based on a position of the thus detected invisible marks, thus aligning each row image of the plurality of row images.

It is preferable that the predetermined invisible marks are a first invisible straight line printed along the one direction or its opposite direction from further upstream than each row image; the first invisible straight line printed in printing of the previous row image is detected in printing each row image; and the printing position is controlled so that the detected position of the first invisible straight line falls within a predetermined range determined in advance, thus aligning each row image.

It is also preferable that the predetermined invisible marks are a first invisible straight line printed along the one direction or its opposite direction from further upstream than each row image; the first invisible straight line is detected by a sensor immediately after printing in printing each row image; and the printing position is corrected so that the detected position of the first invisible straight line falls within a predetermined range determined in advance, thus performing control such that the printing direction of each row image is along with the one direction or its opposite direction.

The method may further comprise: printing a second invisible straight line, which cannot be identified by humans, as the predetermined invisible marks along other direction orthogonal to the one direction or its opposite direction and upstream from each row image in the one direction or its opposite direction, and determining a starting position for printing of each row image by detecting the second invisible straight line printed in printing the previous row image by using a sensor in printing each row image.

It is also preferable that a warning is issued that the printing position of the scanning printing apparatus is not suitable when the detected position of the predetermined invisible marks is outside of a predetermined range in printing each row image.

It is still also preferable that printing of the row image being printed is stopped when the detected position of the predetermined invisible marks is outside of a predetermined range in printing each row image.

BRIEF DESCRIPTION OF THE DRAWINGS

In the accompanying drawings:

FIG. 5 is not appropriate;

DETAILED DESCRIPTION OF THE PREFERRED EMBODIMENTS

Figure 1:
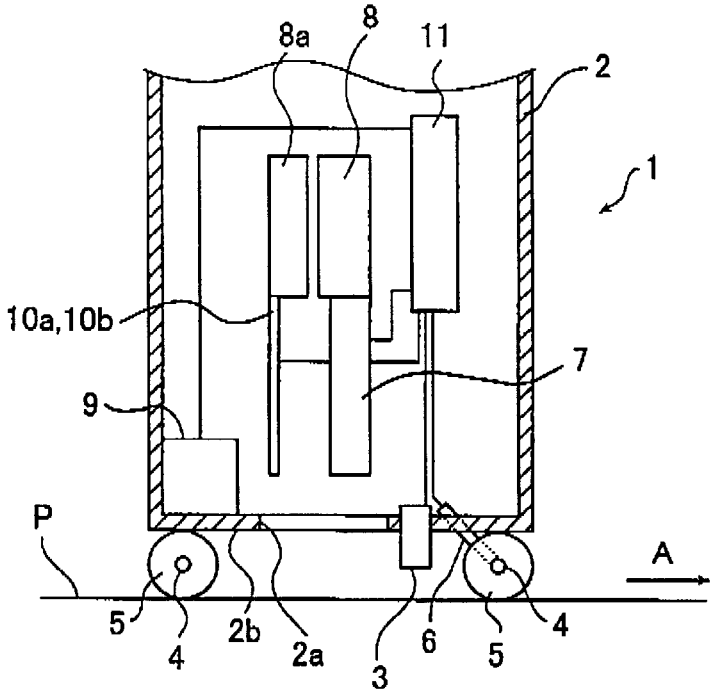
FIG. 1 is a schematic cross sectional diagram showing a scanning printing apparatus according to a first embodiment of the present invention.

A scanning printing apparatus according to the present invention is explained in detail below based on preferred embodiments shown in the attached drawings. FIG. 1 is a schematic cross sectional diagram of a scanning printing apparatus according to a first embodiment of the present invention, FIG. 2 is a bottom diagram showing the scanning printing apparatus according to the first embodiment of the present invention, and FIG. 3 is a block diagram showing a control unit of the scanning printing apparatus of the first embodiment.

Figure 2:
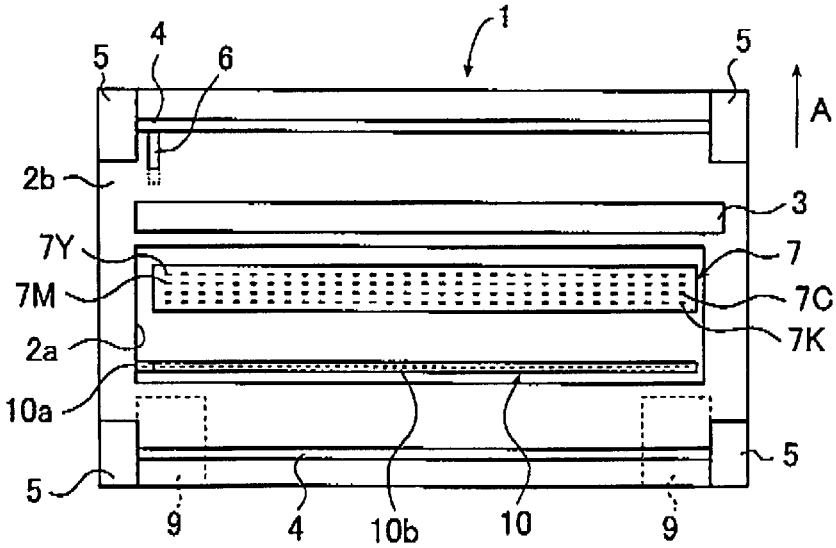
FIG. 2 is a bottom diagram showing the scanning printing apparatus according to the first embodiment of the present invention.
Figure 3:
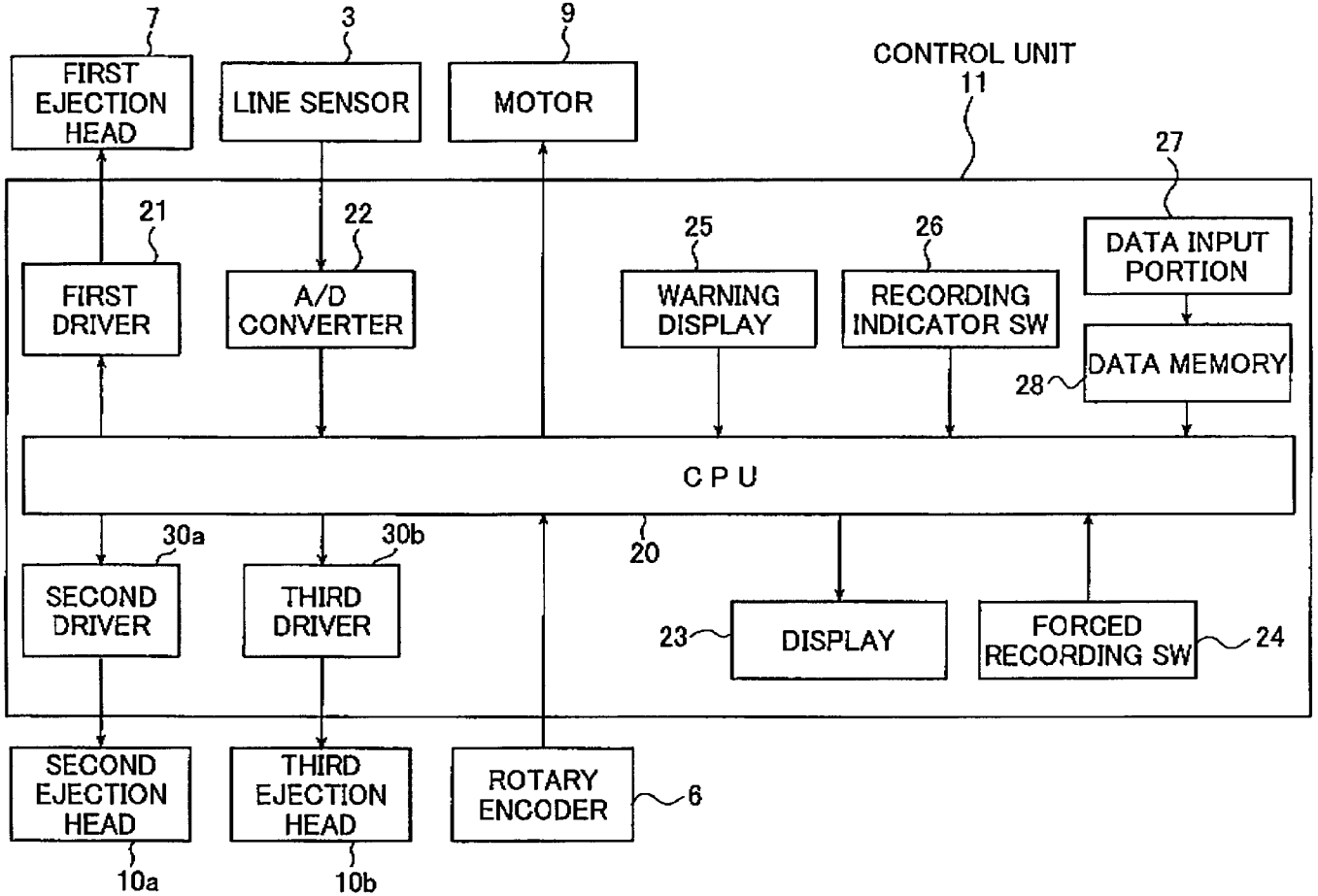
FIG. 3 is a block diagram showing a control unit of the scanning printing apparatus of the first embodiment of the present invention.

As shown in FIG. 1 and FIG. 2, a scanning printing apparatus 1 (hereinafter also referred to simply as a printing apparatus) of the first embodiment has a line sensor 3, a first ejection head 7, a first ink tank 8, a motor 9, a second ejection head 10*a*, a second ink tank 8*a*, a third ejection head 10*b*, and a control unit 11 in the inside of a frame 2. In this embodiment, the frame 2 is manually scanned on a recording medium P in a direction shown by an arrow A (one direction in FIG. 1 (hereinafter referred to as auxiliary scanning direction A)), whereby printing is performed. An opening portion 2*a* extending in a main scanning direction (other direction) that is orthogonal to the auxiliary scanning direction A within a lower surface 2*b* of the frame 2 is formed in the lower surface 2*b* (refer to FIG. 2). A pair of wheels 5 are formed on both ends of an axle 4 extending in the main scanning direction on a downstream side in the auxiliary scanning direction A of the lower surface 2*b* of the frame 2. A rotary encoder 6 is installed in the axle 4, and a pulse signal is generated corresponding to rotation of the wheels 5 due to motion of the frame 2 in the auxiliary scanning direction A. The pulse signal is sent to a CPU 20 within the control unit 11 (refer to FIG. 3). Further, the wheels 5, which turn around the axle 4, are formed in both the ends in the main scanning direction upstream of the lower surface 2*b* of the frame 2 in the auxiliary scanning direction A. Motors 9 are formed for the respective wheels 5, and each of the motors 9 is controlled independently in rotation by the control unit 11. Each of the upstream side wheels 5 is thus controlled independently in rotation.

As shown in FIG. 2, the first ejection head 7 is formed in a position conforming to the opening portion 2*a* in the inside of the frame 2. The first ejection head 7 is a known (ink jet) recording head having nozzles for ejecting ink and ink ejecting means for the respective nozzles. The first ejection head 7 is a line head in which a plurality of nozzles are aligned in the main scanning direction. The line head has, for example, four nozzle row images in the auxiliary scanning direction A: a nozzle row image 7Y for ejecting Y (yellow) ink, a nozzle row image 7M for ejecting M (magenta) ink, a nozzle row image 7C for ejecting C (cyan) ink, and a nozzle row image 7K for ejecting K (black) ink. The first ejection head 7 is formed integrally with the ink tank 8 for supplying ink thereto.

Further, a line head 10 extending in the main scanning direction is formed upstream of the first ejection head 7. The line head 10 comprises the third ejection head 10*b* and the second ejection head 10*a* disposed adjacent to the third ejection head 10*b*, which have substantially the same length as that of the first ejection head 7. The second ejection head 10*a* extends in the main scanning direction further than an edge portion of the first ejection head 7. The second ink tank 8*a* for supplying invisible ink that essentially cannot be recognized by humans is formed integrally with the second ejection head 10*a* and the third ejection head 10*b*. The invisible ink is ejected from the second ejection head 10*a* and the third ejection head 10*b*. The invisible ink is, for example, an ink which is essentially invisible in a visible light region and which absorbs infrared light and exhibits light emission in an infrared light region or which absorbs ultraviolet light and exhibits light emission in an ultraviolet light region. Polymethylene dyes, anthraquinone dyes, dithiol metal salt dyes, phthalocyanine dyes, indophenol dyes, aminium dyes, diammonium dyes, and azo dyes can be given, for example, as infrared fluorescent dyes used in the aforementioned ink exhibiting light emission in the infrared light region.

As shown in FIG. 1, the recording medium P and the lower surface 2*b* become parallel when the frame 2 is in a state of being disposed orthogonally with respect to the recording medium P. The first through third ejection heads 7, 10*a*, and 10*b* are set so as to eject ink from their nozzles in a direction orthogonal to the lower surface 2*b* of the frame 2, and the ink is ejected toward an open space outside the frame 2.

Downstream of the first ejection head 7 of the lower surface 2*b* of the frame 2 in the auxiliary scanning direction A, the line sensor 3 for detecting invisible ink is formed extending in the main scanning direction. A plurality of semiconductor lasers which emit light having a wavelength in the infrared light region, and a plurality of photodiodes for detecting the invisible ink that exhibits light emission from the semiconductor lasers are provided in the line sensor 3 along the main scanning direction in case of, for example, the invisible ink that absorbs infrared light and exhibits light emission in the infrared light region. The position of the invisible straight line in the main scanning direction is thus detected, and the position of the invisible straight line is sent to the control unit 11. The control unit 11 rotates the motor 9 based on the detected position of the invisible straight line detected by the line sensor 3, that is, based on which photodiode detected the invisible straight line, thereby controlling so that the scanning direction of the frame 2 becomes parallel to the auxiliary scanning direction A. At the same time, the ink ejection timing is regulated by the control unit 11 based on output from the rotary encoder 6, and an image is printed. The control unit 11 always understands at which position of the line sensor 3 the invisible straight line is located, and measures whether or not the frame 2 is parallel with the auxiliary scanning direction A. The control unit 11 thus turns the motor 9, controlling rotation of the wheels 5 on the upstream side of the auxiliary scanning direction A so that the printing start position of the next row image and the scanning direction of the frame 2 are parallel with the auxiliary scanning direction A.

The schematic structure of the control unit 11 is shown in FIG. 3. The control unit 11 includes, as shown in FIG. 3, the CPU 20 for controlling the entire scanning printing apparatus 1; a first driver 21 for driving the first ejection head 7; a second driver 30*a* for driving the second ejection head 10*a*; a third driver 30*b* for driving the third ejection head 10*b*; an A/D converter 22 for converting output signals (analog signals) of the line sensor 3 to digital signals; a recording indicator switch (SW) 26 for placing the scanning printing apparatus 1 into a print capable state; a data input portion 27 into which image data and the like are input; a data memory 28 for storing image data; a display 23 for displaying the presence or absence of image data in the printing apparatus 1 or the like; a forced recording switch (SW) 24; a warning display 25 for displaying warnings for cases in which the frame 2 is scanning in a curved direction, or the printing position has deviated from the correct position, that is, for cases in which the position at which the invisible straight line is detected in the main scanning direction of the line sensor 3 is outside of a predetermined range. Note that the CPU 20 determines whether or not the position of the frame 2 is outside of a predetermined range based on the detection signal from the line sensor 3.

Figure 4:
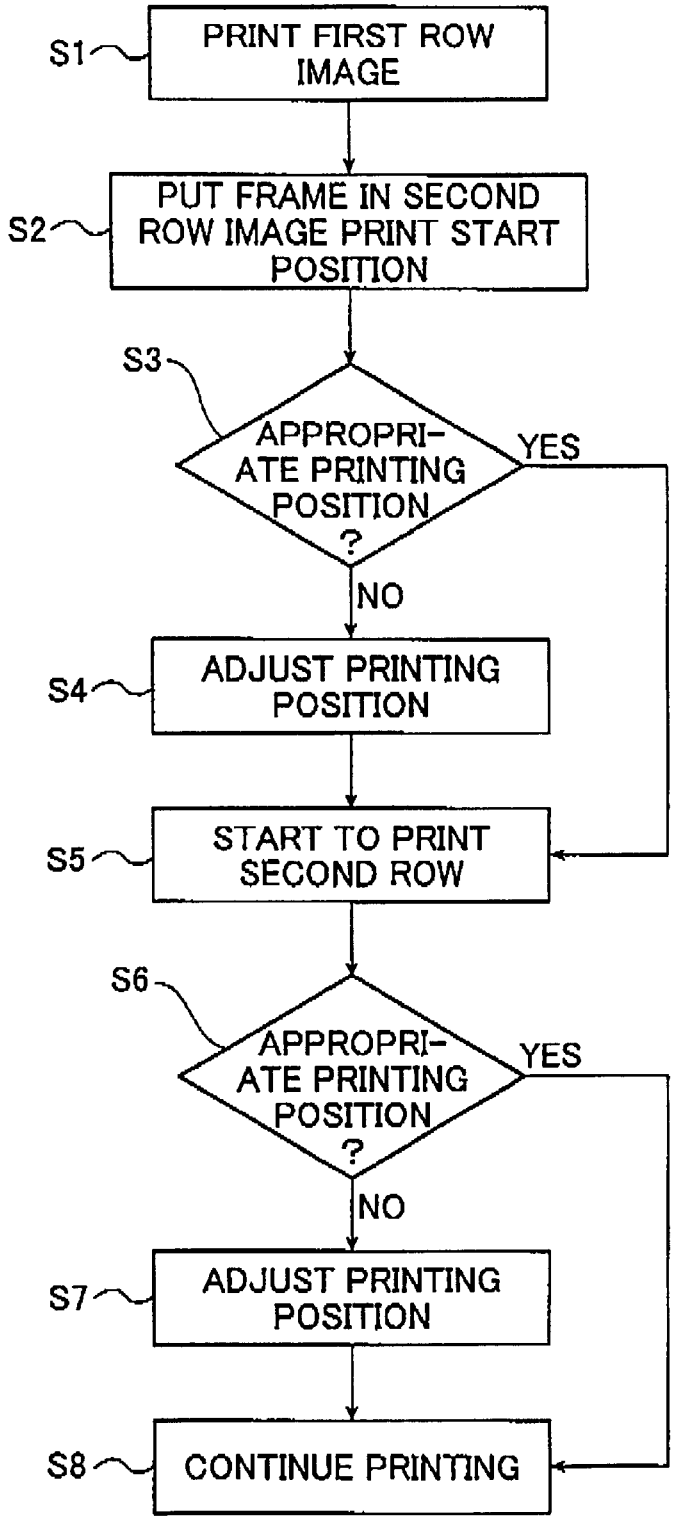
FIG. 4 is a flow chart showing a method of printing by using the scanning printing apparatus according to the first embodiment or the present invention.
Figure 7:
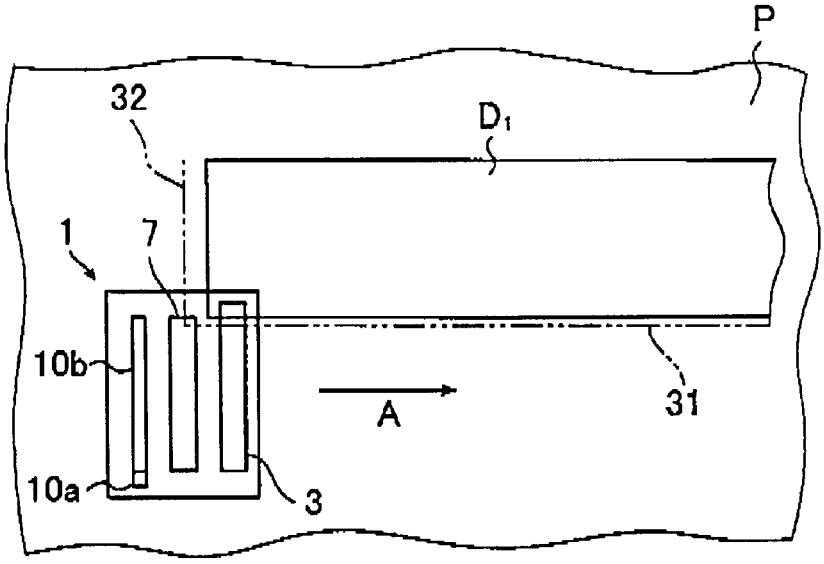
FIG. 7 is a schematic diagram showing a state in which the printing position of the scanning printing apparatus in the next process after
Figure 8:
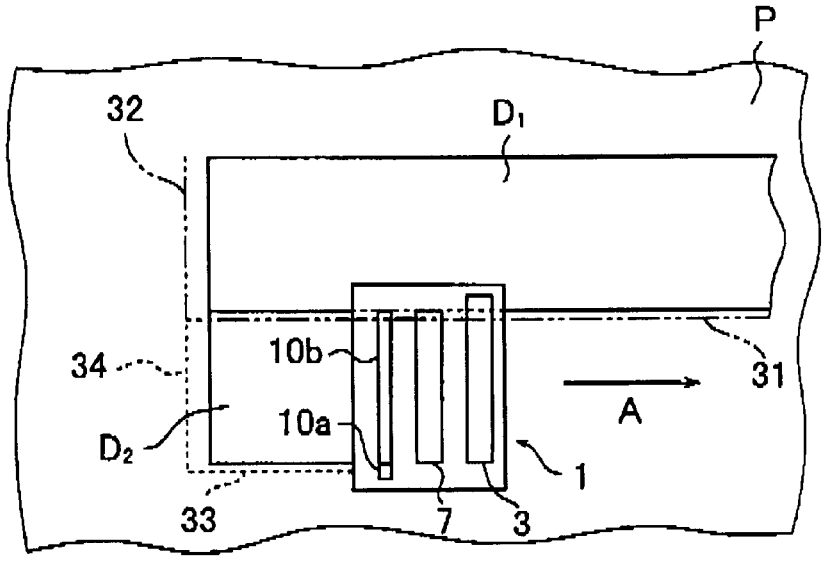
FIG. 8 is a schematic diagram showing the next process after FIG. 6.
Figure 9:
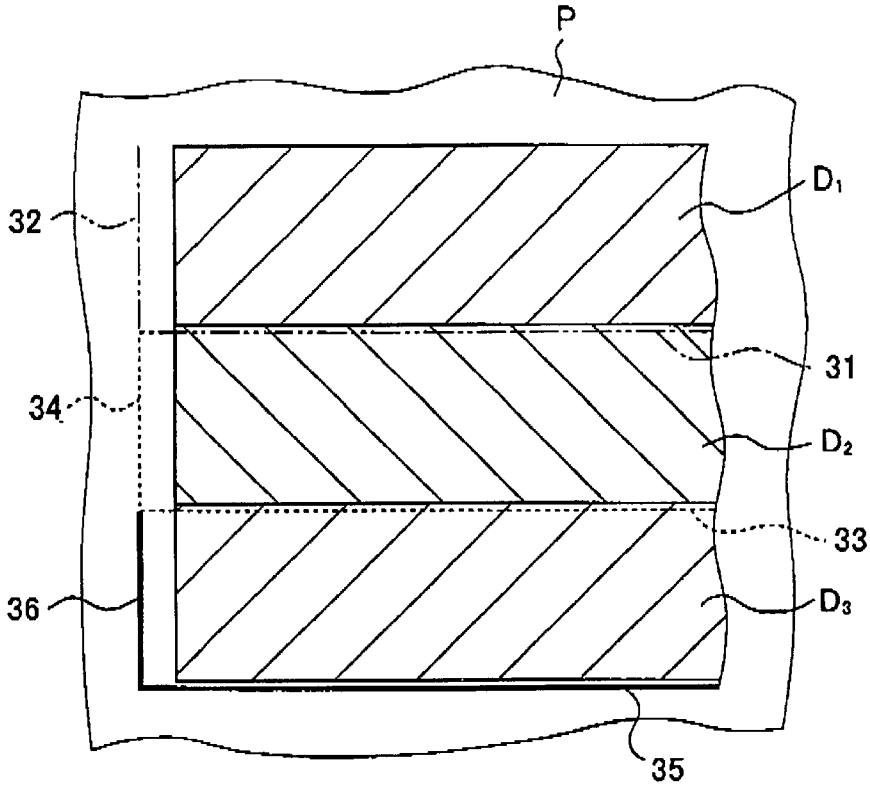
FIG. 9 is a schematic diagram showing the results of printing with the scanning printing apparatus according to the first embodiment of the present invention.

A method of printing by using the scanning printing apparatus 1 of this embodiment is explained next. FIG. 4 is a flow chart showing a printing method using the scanning printing apparatus 1 according to the first embodiment of the present invention, FIGS. 5 to 8 are schematic diagrams showing in process order a method of printing to a recording medium by using the scanning printing apparatus 1 according to the first embodiment of the present invention, and FIG. 9 is a schematic diagram showing results of printing by using the scanning printing apparatus 1 according to the first embodiment of the present invention. Note that the arrangement of the line sensor 3, and the first to third ejection heads 7, 10*a*, and 10*b* is simplified in the scanning printing apparatus 1 shown in FIGS. 5 to 8. Further, the scanning printing apparatus 1 of this embodiment is one for printing by manual scanning, but may be of automatic scanning type. The method of printing according to this embodiment is one capable of printing so that an image of one row image is aligned with an image of the subsequent row image.

An electric power supply of the printing apparatus 1 is turned on first, and displays such as whether or not there is image data are shown in the display 23. Note that, when necessary, selection by a user of an image to be recorded, and the like may be enabled. These functions may be performed by a known method such as a GUI (graphical user interface) using the display 23.

The existence of image data in the data memory 28 is confirmed next, and in addition, whether or not this is image data to be recorded is confirmed. If image data to be recorded is not stored, then image data is introduced into the data memory 28 from the data input portion 27. Note that it is preferable that all image data to be printed over a plurality of row images be stored in the data memory 28. Further, the image data may also be sent to the data input portion 27 sequentially, and printing may be performed for each row image.

Introduction of the image data may be performed by a known method such as downloading using a wire or wireless connection, read out from a loaded recording medium, or the like. Furthermore, a supply source for the image data may be similar to each type of printer, such as a scanner (image reading apparatus), a computer, a digital camera, or a communication network. In addition to the supplied image data, image data of a predetermined pattern may also be stored, and image recording may be performed by the image data of this pattern.

Figure 5:
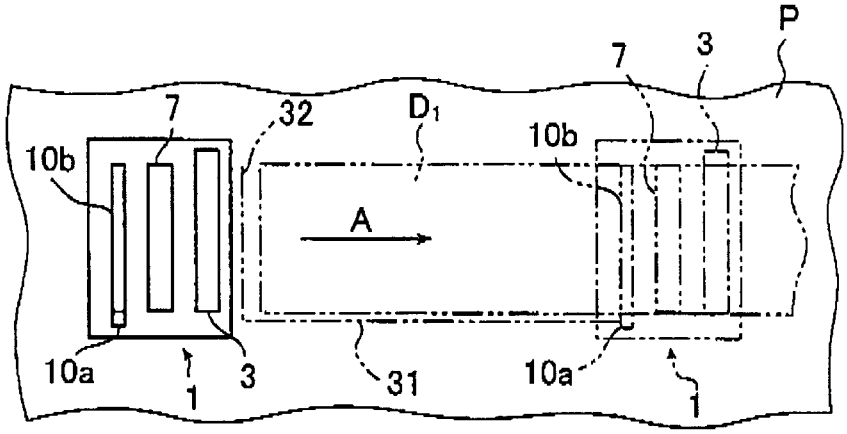
FIG. 5 is a schematic diagram showing a process order of a method of printing to a recording medium by using the scanning printing apparatus according to the first embodiment of the present invention.

Next, the frame 2 is placed and held on the recording medium P, and held by hand, and the frame 2 is moved in the auxiliary scanning direction A while the wheels 5 are kept grounded to the recording medium P as shown in FIG. 5, provided that image data to be recorded exists in the data memory 28 and the recording indicator switch 26 is on. The ink is ejected from the first ejection head 7 based on the image data, and the recorded image is printed in a first image region $D_1$ (step S1). Invisible ink is ejected from the second ejection head 10*a* at this point following the movement of the frame 2, and an invisible straight line 31 (invisible horizontal line) is printed in a direction parallel to the auxiliary scanning direction A on the outside of the next row image of the first image region $D_1$. Further, when printing of the first image region $D_1$ is started, invisible ink is ejected from the third ejection head 10*b*, and an invisible straight line 32 (invisible vertical line) is printed in a direction parallel to the main scanning direction upstream of the first image region $D_1$. The invisible straight line 31 is thus printed at the same time as the image is printed to the first image region $D_1$. Furthermore, although the invisible straight line 32 is printed when printing of the image to the first image region $D_1$ begins, it may also be printed before printing of the image to the first image region $D_1$. As stated above, the invisible straight lines 31 and 32 are printed using an invisible ink that substantially cannot be recognized by humans, and therefore there is no degradation in image quality.

Note that the recording indicator switch 26 may be set to on or off by the user, and further, may also be automatically set to on or off based on the state of the printing apparatus 1, for example whether or not recording is possible.

While scanning is performed, the CPU 20 detects the amount of movement (scanning amount) of the frame 2 based on a pulse signal generated by the rotary encoder 6. The ink ejection timing is synchronized with this movement, and modulation is performed in accordance with an image to be recorded to thereby drive the first ejection head 7 using the first driver 21 and ejection ink from the first ejection head 7 through modulation. An image is thus recorded on the recording medium P.

Figure 6:
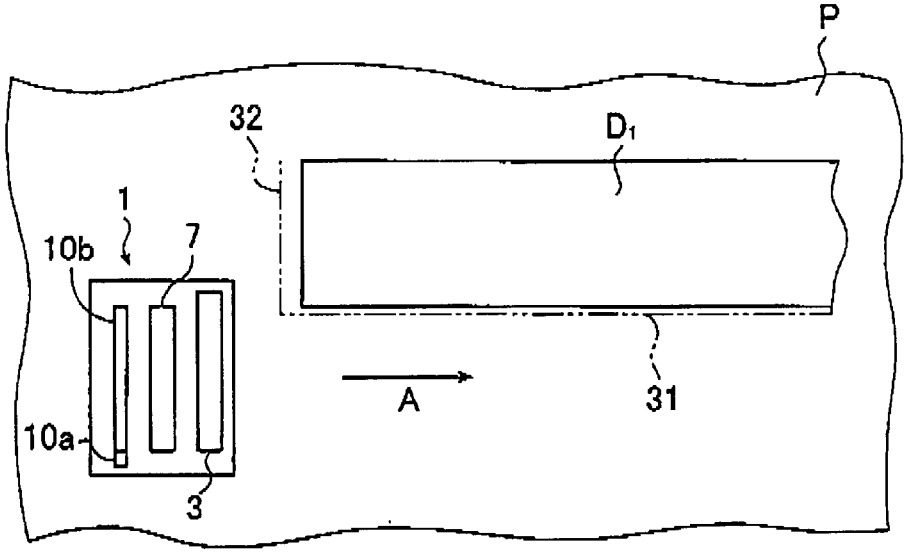
FIG. 6 is a schematic diagram showing the next process after FIG. 5.

A second row image is printed next based on the image data in the data memory 28. The frame 2 is first shifted in the main scanning direction, and the printing apparatus 1 is placed and held on the recording medium P so that a portion of the frame 2 is positioned overlapping with the first image region $D_1$ as shown in FIG. 6 (step S2). The first ejection head 7 is set so as not to overlap with the first image region $D_1$ at this point. The frame 2 is then scanned manually, the invisible straight line 32 extending in the main scanning direction is detected by the line sensor 3, and a determination is made as to whether the printing position of the frame 2 is appropriate or not (step S3). It is preferable to output a warning in the step S3, indicating that the placement position of the frame 2 is not appropriate, by using the warning display 25 for cases in which it is determined by the line sensor 3 that the first ejection head 7 is overlapping with the first image region $D_1$ or that the first ejection head 7 is separated away from the first image region $D_1$ in the main scanning direction. Further, the line sensor 3 cannot detect the invisible vertical line 32 for cases in which the frame 2 is positioned and held on the recording medium P so as to become downstream more than the invisible vertical line 32 in the auxiliary scanning direction A, as shown in FIG. 7. A starting position for printing of the second line therefore cannot be specified. That is, alignment between the first row image and the second row image is lost. It is therefore necessary to again place and hold the frame 2 on the printing medium P further upstream in the auxiliary scanning direction A than the image region $D_1$, as shown in FIG. 6. It is preferable in this case as well to issue a warning by the warning display 25, indicating that the placement position of the frame 2 is not appropriate.

The invisible vertical line 32 can then be detected by manually scanning the frame 2, and the starting position for printing can be specified. The starting position for printing can be specified by the number of pulses output from the rotary encoder 6 after the invisible vertical line 32 is detected, provided that the distance between the invisible vertical line 32 and the image region $D_1$ is known.

Further, if the results of determining whether or not the printing position is appropriate which are obtained by detecting the invisible straight line 31 by using the line sensor 3 show that the position of the frame 2 is not appropriate, then the position of the frame 2 in the main scanning direction and the tilt of the frame 2 with respect to the main scanning direction are adjusted, thus making the position and the direction of the frame 2 appropriate (step S4). That is, the printing position for the second row image is adjusted. The frame 2 is then scanned in the auxiliary scanning direction A, and an image is printed in a second image region $D_2$, in alignment with the first image region $D_1$ (step S5). In this case, the position of the invisible straight line 31 is always detected by the line sensor 3 while the frame 2 is scanned manually, as shown in FIG. 8, and the amount of shift of the frame 2 in the main scanning direction during printing is obtained. The amount of shift is checked to see whether or not it is within a predetermined range, and a determination of whether or not the printing position is appropriate is made (step S6).

Further, at the same time as the amount of movement (scanning amount) of the frame 2 is detected, measurement of the position of the invisible straight line 31 in the main scanning direction is performed by the line sensor 3 in response to pulse signals emitted by the rotary encoder 6. The results of detecting the position of the invisible straight line 31 by using the line sensor 3 (output signal) are converted into a digital signal by the A/D converter 22 and then sent to the CPU 20.

It is preferable that the timing for measurements by the line sensor 3 be such that measurement by the line sensor 3 is performed every time the user moves the frame 2 by a predetermined amount in the auxiliary scanning direction A, in other words, every time a predetermined number of pulse signals are emitted by the rotary encoder 6. Further, it is also preferable to perform measurements by the line sensor 3 at predetermined time intervals or at predetermined intervals based on the number of clocks. Note that the line sensor 3 measurement timing or the ink ejection time may also be suitably set in response to the required image quality and the like.

The CPU 20 (determining means) confirms the detection results. If the measured position of the invisible straight line 31 is outside of a set value range, then modulation in accordance with an image to be recorded is performed in response to the movement of the frame 2 by a user, that is, in synchronization with the generation of pulse signals from the rotary encoder 6. At the same time, the amount of shift between the permissible value and the measured value is computed for a fluctuation in the main scanning direction of the invisible straight line 31 detected by the line sensor 3. The CPU 20 then issues a command to rotate one of the motors 9 in response to the amount of shift so that the amount of shift falls within the set value range, and the speeds of the respective wheels 5 on the upstream side in the auxiliary scanning direction A are made equal. The scanning direction of the frame 2 is made parallel to the auxiliary scanning direction A. Ink is adjusted in accordance with an image to be recorded through modulation and is ejected from the first ejection head 7 for only a predetermined period of time (for only a predetermined number of lines).

If the amount of shift of the frame 2 is within the predetermined range in the step S6, that is, if the position of the invisible straight line 31 found by the line sensor 3 is within the predetermined range, then printing continues as it is (step S8).

On the other hand, one of the motors 9 is rotated, and the rotational speeds of the left and right wheels 5 on the upstream side in the auxiliary scanning direction A are made equal, thus making the frame 2 in a direction parallel to the auxiliary scanning direction A and correcting the printing position of the frame 2 for cases in which the trajectory of the frame 2 in the auxiliary scanning direction A cannot be maintained with a predetermined linearity, causing print to be curved, that is, for cases in which the photodiode output position of the line sensor 3 is outside of a predetermined range (step S7). Printing then continues (step S8). As stated above, if the printing position for the second row image of the image shifts, and the amount of shift is outside of the predetermined range, then the fact that the amount of shift is not within the predetermined range is displayed (warning display) by the warning display 25, for example. The left or right motor 9 is driven in accordance with the amount of shift for cases in which the printing position of the second row image of the image has shifted in printing the second row image of the image in this embodiment. Position adjustment of the frame 2 is thus forcibly performed, and therefore the image of the second image region $D_2$ can be printed in alignment with the image of the first image region $D_1$ as shown in FIG. 9, even if the printing position of the frame 2 shifts.

Note that an invisible straight line (invisible horizontal line) 33 and an invisible straight line (invisible vertical line) 34 are printed when printing the second image region $D_2$ as shown in FIG. 9, similar to printing of the first image region $D_1$ discussed above.

A third row image is printed next based on a third row image of image data in the data memory 28. By repeating the processes of the steps S2 through S8, the third row image can be printed in a third image region $D_3$ as shown in FIG. 9, similar to the second row image, that is, similar to printing of the image in the second image region $D_2$. The image is also printed in alignment with the already printed invisible straight line 33 in this case as well, and further, invisible straight lines 35 and 36 are also printed in the same way as described above. Whether or not image data to be recorded next exists in the data memory 28 is then verified. If image data exists, and a recording command has been issued, then image recording similar to that of the second row image is performed for fourth and subsequent row images, for the number of row images required.

Note that it is not necessary to print the invisible straight lines for the image corresponding to the very last row image because a subsequent row image is not printed. Control may therefore be performed such that invisible ink is not ejected from the second ejection head 10*a* and the third ejection head 10*b* for cases in which the image data over a plurality of row images is divided and printing of the row image corresponding to the last row image is performed.

Further, the image data whose recording has been finished is then erased from the data memory 28 automatically or in response to a command issued by a user. It is preferable that the image data erasure be selectable.

The present invention is not limited to the aforementioned methods, and the CPU 20 confirms the forced recording switch 24 for cases in which the results of detecting the invisible straight lines 31, 33, and 35 using the line sensor 3 are outside the set values. If the forced recording switch 24 is on, then ink may be ejected for a fixed period of time and image recording may be performed forcibly without rotating the motor 9, although it is necessary to operate the motor 9.

Further, the frame 2 may be placed in a proper printing position by rotating the motor 9 in accordance with a signal from the CPU 20, as stated above, for cases in which the forced recording switch 24 is off.

Note that resumption of image recording may occur after a certain command input is made from the user (for example, the recording indicator switch 26 is on). Further, the electric power supply of the printing apparatus 1 may automatically turn off along with forced termination of the image recording, and the image recording may be resumed by the user after the electric power supply is turned on again.

The line sensor 3 is formed downstream of the first ejection head 7 in this embodiment, and therefore the invisible straight line printed for the previous row image is certainly detected in advance by the line sensor 3, and the position of the frame 2 in the main scanning direction is measured. Printing can consequently be performed with the printing position accurately adjusted. The images composed of a plurality of row images are thus aligned, and printing on the recording medium P can be performed so as to obtain a final image with high quality.

Further, fluctuations in the movement speed of the printing apparatus 1 caused by the user, and fluctuations of the frame 2 in the main scanning direction due to scanning in the auxiliary scanning direction are compensated for in this embodiment, and appropriate image recording over a plurality of row images is possible. In addition, the linearity of the images in the second and subsequent row images, that is, the degree with which the second and subsequent row images are parallel to the first row image is forcibly corrected by the motor 9, and therefore it is not necessary for the user to finely control the linearity of the scanning of the frame 2. Further, the invisible straight lines are printed, at least upstream of the image regions, and therefore it is not necessary for the user to finely control the printing position.

Note that, although the speed of each of the wheels 5 on the upstream side in the auxiliary scanning direction A is controlled by the motor 9 in this embodiment, there are no limitations placed on this constitution, and the speed of each of the wheels 5 may also be adjusted by using a brake, for example.

Further, in a preferred embodiment, a supplemental wheel is disposed in the lower surface 2*b* of the frame 2 in order to prevent the recording medium P from floating up, and to enable recording of an image with high quality by maintaining a fixed recording medium P position for ink ejection from the first to third ejection heads 7, 10*a*, and 10*b*. The supplemental wheel may be a roller that rotates in the auxiliary scanning direction A. Among rollers capable of contacting the recording medium P after image recording (after ink acceptance), ones in which the contact surface area with the recording medium P is small are preferable. For example, spur shaped rollers, rollers having attached bumps, and the like are preferable.

Note that, in addition to the four nozzle row images, the structure of the first ejection head 7 may also be one having ink row images such as light C and light M ink row images in this embodiment. Furthermore, a monochrome printer that ejects only K ink may also be used, for example, instead of a color printer. In addition, it is not necessary to form the line sensor 3 across the entire region of the first ejection head 7. The line sensor 3 may be formed within a range in which the invisible straight lines 31, 33, and 35 can be detected by using the second ejection head 10*a*.

Figure 10:
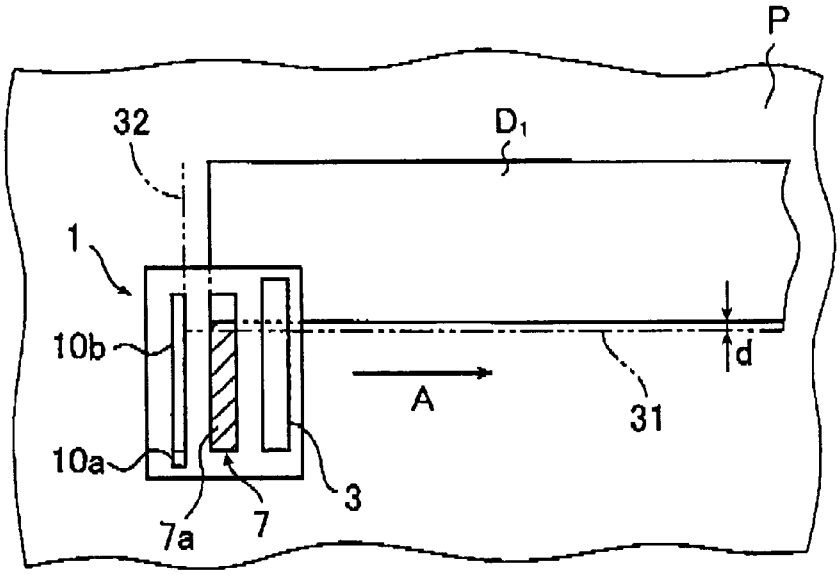
FIG. 10 is a schematic diagram showing a modified example of the printing method of the first embodiment of the present invention.

Further, although the second row image is printed in this embodiment with the first ejection head 7 not overlapping with the first image region $D_1$, there are no limitations placed on this constitution, and printing may also be performed with the first ejection head 7 overlapping with the first image region $D_1$. FIG. 10 is a schematic diagram showing a modified example of the printing method of the first embodiment of the present invention, and shows steps subsequent to those shown in FIG. 6. The invisible vertical line 32 is detected by the line sensor 3 in this modified example, and as a result, printing can be performed for even cases in which the orientation of the frame 2 is proper, but the position of the frame 2 has shifted to the first image region $D_1$ side in the main scanning direction, that is for cases in which the first ejection head 7 overlaps with the first image region $D_1$. A gap d between the invisible straight line 31 and the first image region $D_1$ is known in advance, and therefore the amount of image overlap is calculated from the position of the invisible straight line 31 detected by the line sensor 3 in this case, and a ejection region 7*a* for ejecting ink (shaded portion in the figure) is determined in the first ejection head 7. The image data is then shifted so as to align with the first image region $D_1$, and ink is ejected from the ejection region 7*a*, thus performing printing of the second row image. The second row image can thus be printed in alignment with the first image region $D_1$, even for cases in which the orientation of the frame 2 is correct and the frame 2 has shifted in the main scanning direction to the first image region $D_1$ side. Further, it is also preferable in this modification example as well to issue a warning from the warning display 25 for cases in which the first ejection head 7 does not overlap with the first image region $D_1$ in printing the second row image.

Figure 11:
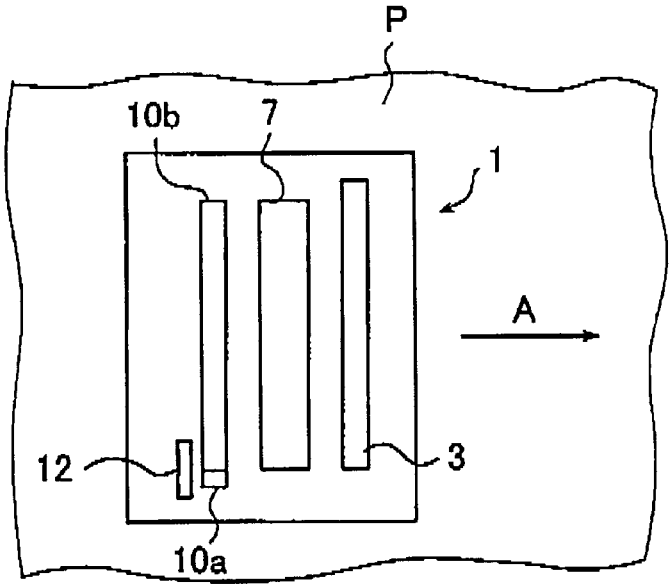
FIG. 11 is a schematic diagram showing a scanning printing apparatus according to a second embodiment of the present invention.

A second embodiment of the present invention is explained next. FIG. 11 is a schematic diagram showing a scanning printing apparatus according to the second embodiment of the present invention. The line sensor 3, the first through third ejection heads 7, 10*a*, and 10*b*, and a sensor 12 are shown in the scanning printing apparatus 1 of this embodiment shown in FIG. 11, but other structures are omitted. Note that the same reference numerals are attached to structures identical to those of the first embodiment shown in FIGS. 1 to 10, and that detailed explanations of such structures are omitted. The second embodiment differs from the first embodiment in that the sensor 12 is formed on the upstream side of the second ejection head 10*a* in the auxiliary scanning direction A. Other structures are similar to those of the first embodiment discussed above. The sensor 12 is connected to the CPU 20, similar to the line sensor 3, and a determination is made as to whether or not the detection results from the sensor 12 are within a predetermined range (permissible range).

In this embodiment, the sensor 12 is formed further upstream than the second ejection head 10*a*, and therefore the invisible straight line 31 can be detected by the sensor 12 immediately after the invisible straight line 31 is printed. Whether or not the printed invisible straight line 31 is a straight line, that is whether or not the first row image is printed straightly, is therefore determined. If the invisible straight line 31 is outside of the aforementioned permissible range, then the speed of either the left or right wheel 4 is adjusted by the control unit 11, thus adjusting the frame 2 so as to be scanned in a straight line. The linearity of the first image region $D_1$ of the first row image can thus be increased. Note that, when comparing the printing method to that of the first embodiment, the point that printing is performed while confirming the linearity of the first row image here differs, while other portions of the printing method are similar to those of the first embodiment.

As stated above, the linearity of the first image region $D_1$ of the first row image can be improved in this embodiment, and subsequent images can also be printed with good linearity in alignment with the image region of the previous row image. Printing of an image composed of a plurality of row images can therefore be performed having even better image quality. Further, it is preferable to issue a warning from the warning display 25 in this embodiment as well for cases in which the first ejection head 7 does not overlap with the first image region $D_1$ in printing the second image region $D_2$ of the second row image. That is, it is preferable to issue a warning for cases in which the first ejection head 7 does not overlap with the image region of the previous row image, and there is a gap between the printed image of the previous row image and the image of the following row image in printing the image of the following row image.

Figure 12:
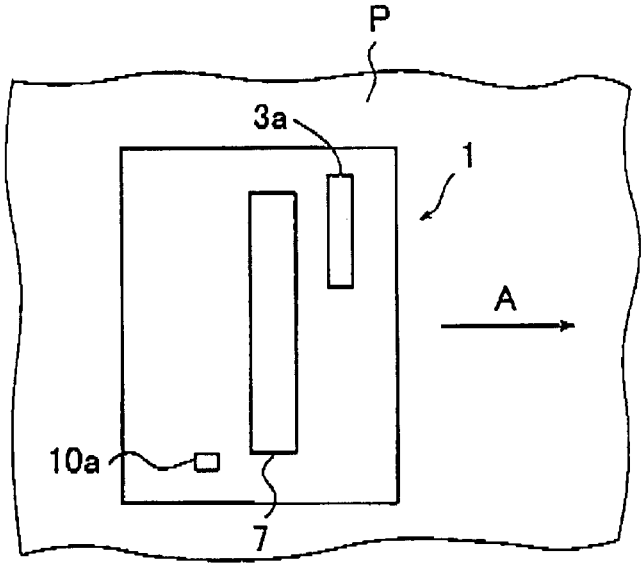
FIG. 12 is a schematic diagram showing a scanning printing apparatus according to a third embodiment of the present invention.
Figure 13:
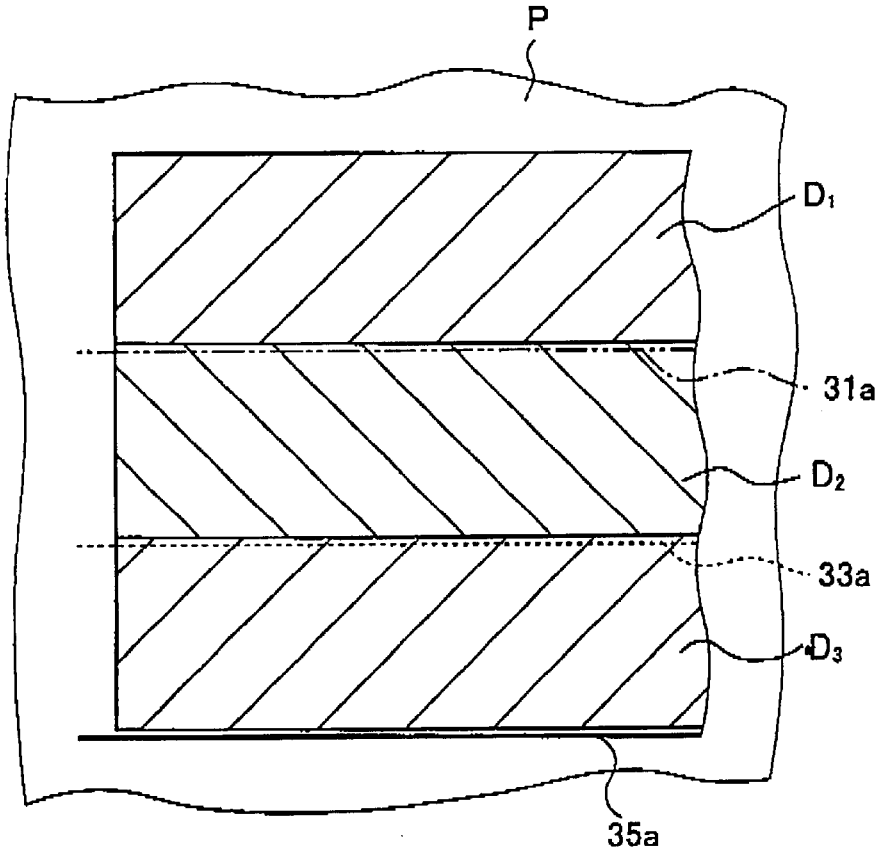
FIG. 13 is a schematic diagram showing the results of printing with the scanning printing apparatus according to the third embodiment of the present invention.

A third embodiment of the present invention is explained next. FIG. 12 is a schematic diagram showing a scanning printing apparatus according to the third embodiment of the present invention, and FIG. 13 is a schematic diagram showing the results of printing by the scanning printing apparatus according to the third embodiment of the present invention. The line sensor 3*a*, the first ejection head 7, and the second ejection head 10*a* are shown in the scanning printing apparatus 1 shown in FIG. 12, and other structures are omitted. Note that the same reference numerals are attached to structures that are identical to those of the first embodiment shown in FIGS. 1 to 10, and that detailed explanations of such structures are omitted. In comparing this embodiment with the first embodiment, the third ejection head 10*b* is not formed in this embodiment, as shown in FIG. 12. Further, this embodiment differs from the first embodiment in that the line sensor 3*a* is not formed in all regions of the first ejection head 7 and in that the length of the line sensor 3*a* is the length capable of detecting the invisible straight lines 31*a*, 33*a*, and 35*a* printed by the second ejection head 10*a*, and other structures are similar to those of the first embodiment discussed above. Further, as to the printing method, this embodiment differs from the first embodiment in that the invisible straight lines 32, 34, and 36 extending in the main scanning direction are not printed, and only the invisible straight lines 31*a*, 33*a*, and 35*a* extending in the auxiliary scanning direction are printed as shown in FIG. 13. Other portions of the printing method are similar to those of the first embodiment.

The first image region $D_1$ of the first row image and the invisible straight line (invisible horizontal line) 31*a* are printed first in this embodiment, as shown in FIG. 13. The frame 2 is then placed and held upstream of the first printing region $D_1$ in the auxiliary scanning direction A, and the frame 2 is scanned in the auxiliary scanning direction A. The invisible straight line 31*a* is detected next. The invisible straight line 31*a* is printed from further upstream than the first image region $D_1$. The edge of the invisible straight line 31*a* is therefore detected before printing the second row image, and whether or not the printing position and orientation of the frame 2 are appropriate can be determined based upon the detection results. That is, the photodiodes which detect the invisible straight line 31*a* investigate whether or not it is within a predetermined range. If the results show that the printing position and orientation are not appropriate, then the position of the invisible straight line 31*a* in the line sensor 3*a* is adjusted so as to be within the predetermined range by shifting the frame 2 in the main scanning direction and/or in the auxiliary scanning direction, similar to the first embodiment (refer to FIG. 6). Printing of the second line is then performed. In this case, it is preferable to issue a warning from the warning display 25 if the printing position and orientation are not appropriate, for example, if the frame 2 has shifted to the next row image side in the main scanning direction and the first ejection head 7 does not overlap with the first image region $D_1$. Correction is performed similar to the first embodiment for cases in which the scanning direction of the frame 2 has shifted in printing the second row image.

As discussed above, even if the invisible straight line 32 extending in the main scanning direction is not found in the first image region $D_1$ as shown in FIG. 9, the printing position of the frame 2 can be adjusted, and the image in the second image region $D_2$ can be printed in alignment with the first row image while detecting the invisible straight line 31*a*, as long as the invisible straight line 31*a* is printed on the upstream side of the printing region. Further, the third row image can also be printed similar to the second row image. The respective images composed of a plurality of row images can thus be printed in alignment. Note that the fourth and subsequent row images can also be printed in accordance with the image data by a printing method similar to that used for the second row image in this embodiment as well.

The second ejection head 10*a* is formed so that the invisible straight lines 31*a*, 33*a*, and 35*a* are printed on the outside of the image in the main scanning direction in this embodiment, and the invisible straight lines 31*a*, 33*a*, and 35*a* which are parallel to the respective image regions $D_1$, $D_2$, and $D_3$ are printed outside the image regions $D_1$, $D_2$, and $D_3$. The distance between the second ejection head 10*a* and the first ejection head 7 in the main scanning direction is fixed. Further, the distance between edges of the invisible straight lines 31*a*, 33*a*, and 35*a*, and the image starting position in the auxiliary scanning direction A is also determined in advance and remains unchanged. The starting position and the seam for each image are therefore understood. The printing position can thus be accurately determined, and the images composed of a plurality of row images can be printed easily with high quality.

Further, the edges can be easily detected by making thicker the invisible straight lines 31*a*, 33*a*, and 35*a*, printed along the auxiliary scanning direction A. This is preferable because the starting point for printing the image is seen more easily. Note that anywhere may be used for the position to start printing the invisible straight lines, and that they may be printed right up against the image region, provided that they are upstream from the image region in the auxiliary scanning direction A.

Figure 14:
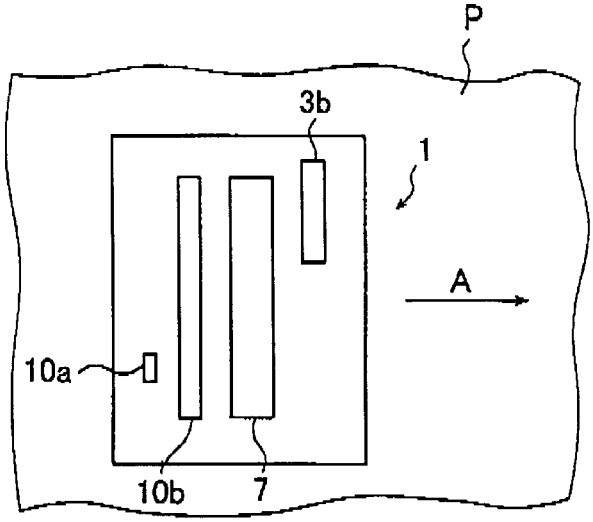
FIG. 14 is a schematic diagram showing a scanning printing apparatus according to a fourth embodiment of the present invention.
Figure 15:
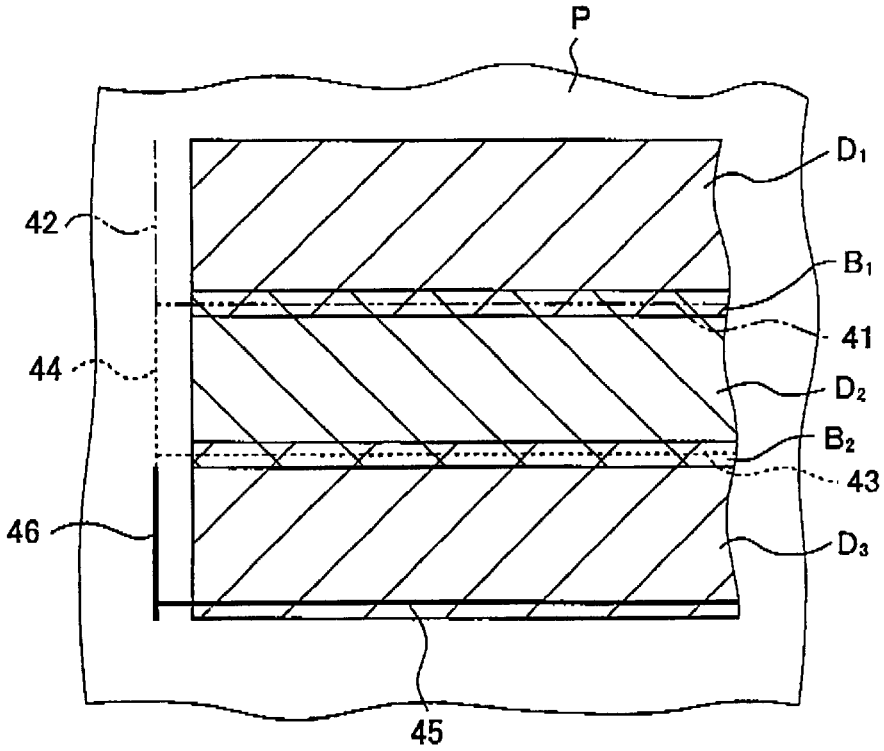
FIG. 15 is a schematic diagram showing the results of printing with the scanning printing apparatus according to the fourth embodiment of the present invention.

A fourth embodiment of the present invention is explained next. FIG. 14 is a schematic diagram showing a scanning printing apparatus according to the fourth embodiment of the present invention. FIG. 15 is a schematic diagram showing the results of printing by using the scanning printing apparatus according to the fourth embodiment of the present invention. The line sensor 3*b* and the first through third ejection heads 7, 10*a*, and 10*b* are shown in the scanning printing apparatus 1 of this embodiment shown in FIG. 14, and other structures are omitted. Note that the same reference numerals are attached to structures that are identical to those of the first embodiment shown in FIGS. 1 to 10, and that detailed explanations of such structures are omitted here. In all of the embodiments discussed above, the invisible straight lines are printed outside of each image in the main scanning direction, and images composed of all regions of the first ejection head 7 are aligned-and printed. In the fourth embodiment, however, the invisible straight lines are printed on the inside of the respective image regions. Images in the second and subsequent row images are not printed using the nozzles over the entire region of the first ejection head 7, but are printed so that a portion of the first ejection head 7 overlaps with the image of the previous row image.

Comparing the fourth embodiment with the first embodiment, the fourth embodiment differs in that the second ejection head 10*a* is disposed within the length of the first ejection head 7 in the main scanning direction, as shown in FIG. 14, and in addition, the line sensor 3*b* is changed to a position at which invisible straight lines 41, 43, and 45, printed by the second ejection head 10*a*, can be detected. Other structures are similar to those of the first embodiment.

In this embodiment, the invisible straight lines 41, 43, and 45 extending in the auxiliary scanning direction A within the first image region $D_1$, the second image region $D_2$, and the third image region $D_3$ are printed further upstream as shown in FIG. 15, and invisible straight lines 42, 44, and 46 extending in the main scanning direction are printed further upstream in the auxiliary scanning direction A than the first image region $D_1$, the second image region $D_2$, and the third image region $D_3$. In addition, an overlap region $B_1$ where the first image region $D_1$ overlaps with the second image region $D_2$, and an overlap region $B_2$ where the second image region $D_2$ overlaps with the third image region $D_3$ are formed and printed. The overlap regions $B_1$ and $B_2$ are portions that overlap with the first ejection head 7. The overlap region $B_1$ is printed when the first image region $D_1$ is printed, and the overlap region $B_2$ is printed when the second image region $D_2$ is printed. The overlap regions $B_1$ and $B_2$ have the same width. Control is performed by the control unit 11 so that the image data corresponding to the area of the overlap portion $B_1$ is shifted by the amount of the overlap portion $B_1$ in the main scanning direction to the next row image side in printing the second image region $D_2$, and ink is not ejected from the nozzles of the first ejection head 7 in only the overlap portion $B_1$ area. Further, control is similarly performed by the control unit 11 so that the image data corresponding to the area of the overlap portion $B_2$ is shifted by the amount of the overlap portion $B_2$ in the main scanning direction to the next row image side in printing the third image region $D_3$, and ink is not ejected from the nozzles of the first ejection head 7 in only the overlap portion $B_2$ area. Furthermore, it is preferable in this embodiment as well to issue a warning for cases in which the first ejection head 7 does not overlap with the image region of the previous row image in printing the image of the next row image in the image region of the previous row image, similar to the second embodiment discussed above.

Note that, as discussed above in the third embodiment, the printing position can be suitably adjusted to print images composed of a plurality of row images in this embodiment as well, even if the invisible straight lines 42, 44, and 46 extending in the main scanning direction do not exist. Further, nozzles in the entire region of the first ejection head 7 can be used in printing in this embodiment, provided that the positional relationship between the line sensor 3*b* and the second ejection head 10*a* is considered, such as extending the line sensor 3*b* in the main scanning direction and disposing the second ejection head 10*a* in the vicinity of an edge portion of the first ejection head 7 in the main scanning direction.

Known ink jet recording heads may be used for the first through third ejection heads 7, 10*a*, and 10*b* in the printing apparatus 1 of the present invention, as discussed above. The first through third ejection heads 7, 10*a*, and 10*b* are printing heads in which a plurality of nozzles are formed on a substrate. For example, the first through third ejection heads 7, 10*a*, and 10*b* may be of so-called top shooter type (face ink jet type) in which ink is ejected in a direction perpendicular to the substrate, or of so-called side shooter type (edge ink jet type) in which ink is ejected in a direction parallel to the substrate. Further, thermal ink jet type in which ink is ejected by heat from a heater may also be used, and recording heads may also be used in which ink is ejected by a force developed by vibrating a diaphragm formed in an ink chamber using a piezoelectric element, static electric force, or the like.

Note that a warning may be issued by the warning display 25, and that printing may also be stopped, for cases in which the amount of shift in the printing position during printing is not within a permissible range, in any of the embodiments. Ink may be prevented from being ejected from the first ejection head 7, or the wheels 5 may be locked, as to methods of stopping printing.

Further, the present invention is not limited to the aforementioned embodiments. Instead of correcting a shift of the frame in the main scanning direction with respect to the invisible straight lines through control of the frame position, the amount of shift in the printing position with respect to the previous row image may be measured before printing the second and subsequent row images, and the image data may be corrected based on the measurement results and then printed. The images composed of a plurality of row images can thus be printed in alignment by not correcting the scanning direction of the frame but correcting the image data to be printed.

Note that, although the invisible straight lines are printed as predetermined marks incapable of being recognized by humans, and the printing position is corrected by detecting these marks in each of the aforementioned embodiments, the predetermined marks are not limited to the invisible straight lines. Marks in which dots are aligned at regular intervals, or marks having other shapes may also be used, for example, for the predetermined invisible marks, which are detected and used for controlling the printing position.

The scanning printing apparatus 1 of the present invention has been explained in detail above, but the present invention is not limited to the aforementioned embodiments. Various improvements and changes may of course be made, provided that they do not deviate from the gist of the present invention. For example, although the user moves the printing apparatus 1 by hand in the aforementioned embodiments, an automatic printing apparatus 1 may also be used by employing a method such as forming actuators on the axle 4.

The invisible marks which become standards are printed at the same time as images for respective row images in accordance with the present invention as explained in detail above. In addition, the frame has the first sensor for detecting the invisible marks, and the control means for correcting the printing position of the frame. Therefore, a correction can be made in printing the next row image, even if there is a shift with respect to the image of the previous row image, and the image of the next row image can be printed in alignment with the image of the previous row image. The images composed of a plurality of row images can therefore be easily printed with high quality.

What is claimed is:

1. A scanning printing apparatus for printing an image composed of a plurality of row images, in accordance with image signals, each row image being printed while moving in one direction or its opposite direction on a recording medium, comprising:

moving means for moving said scanning printing apparatus itself on the recording medium in said one direction or its opposite direction;

a first ejection head for printing each row image of the image on the recording medium, having: a plurality of nozzles for ejecting ink, disposed in another direction orthogonal to said one direction; and ink ejecting means disposed corresponding to said plurality of nozzles and modulated and driven in accordance with the image signals;

a second ejection head for printing predetermined invisible marks which cannot be identified by humans on the recording medium;

a first sensor for detecting said predetermined invisible marks which have been printed on the recording medium; and control means for controlling said moving means based on detection results of the first sensor.

2. The scanning printing apparatus according to claim 1, wherein:

said second ejection head prints an invisible straight line, which cannot be identified by humans, as said predetermined invisible marks along said one direction or its opposite direction from a side further upstream than a portion at which a region printed by said first ejection head begins;

said first sensor detects position of said invisible straight line in said other direction; and said control means controls said moving means so that the position of the invisible straight line in said other direction, which is detected by said first sensor, is held within a predetermined range.

3. The scanning printing apparatus according to claim 1, further comprising:

a third ejection head for printing on the recording medium other predetermined invisible marks which cannot be identified by humans and which extend in said other direction and at least, further upstream in said one direction or its opposite direction than said first ejection head; and a second sensor for detecting said other predetermined invisible marks which have been printed on the recording medium by said third ejection head.

4. The scanning printing apparatus according to claim 1, wherein:

said control means has determining means for determining whether a position of said first ejection head is suitable for printing or not, and said apparatus further comprising:

warning generating means for generating a predetermined warning when said determining means determines based on the detection results of said first sensor, that said position of said first ejection head is not suitable for printing.

5. The scanning printing apparatus according to claim 1, wherein:

control means has determining means for determining whether a position of said first ejection head is suitable for printing or not, and said control means controls said moving means to correct said position of said first ejection head so as to be suitable for printing when said determining means determines based on the detection results of said first sensor, that said position of said first ejection head is not suitable.

6. The scanning printing apparatus according to claim 1, further comprising:

a storage unit for storing image signals for said image composed of said plurality of row images which is printed on the recording medium.

7. A method of printing an image composed of a plurality of row images in accordance with image signals on a recording medium by using a scanning printing apparatus having moving means for moving the scanning printing apparatus itself on the recording medium in one direction or its opposite direction, the apparatus printing each row image of said image while moving in said one direction or its opposite direction on the recording medium, comprising:

printing predetermined invisible marks which cannot be identified by humans, while printing each row image of the image composed of said plurality of row images;

detecting said predetermined invisible marks that have been printed in a previous row image in printing of each row image; and correcting a printing position based on a position of the thus detected invisible marks by controlling said moving means in response to said detection, thus aligning each row image of said plurality of row images.

8. The method of printing by using the scanning printing apparatus according to claim 7, wherein:

said predetermined invisible marks are a first invisible straight line printed along said one direction or its opposite direction from further upstream than each row image;

said first invisible straight line printed in printing of the previous row image is detected in printing each row image; and said printing position is controlled so that the detected position of the first invisible straight line falls within a predetermined range determined in advance, thus aligning each row image.

9. The method of printing by using the scanning printing apparatus according to claim 7, wherein:

said predetermined invisible marks are a first invisible straight line printed along said one direction or its opposite direction from further upstream than each row image;

said first invisible straight line is detected by a sensor immediately after printing in printing each row image; and said printing position is corrected so that the detected position of the first invisible straight line falls within a predetermined range determined in advance, thus performing control such that the printing direction of each row image is along with said one direction or its opposite direction.

10. The method of printing by using the scanning printing apparatus according to claim 7, further comprising:

printing a second invisible straight line, which cannot be identified by humans, as said predetermined invisible marks along another direction orthogonal to said one direction or its opposite direction and upstream from each row image in said one direction or its opposite direction, and determining a starting position for printing of each row image by detecting the second invisible straight line printed in printing the previous row image by using a sensor in printing each row image.

11. The method of printing by using the scanning printing apparatus according to claim 7, wherein:

a warning is issued that the printing position of said scanning printing apparatus is not suitable when the detected position of the predetermined invisible marks is outside of a predetermined range in printing each row image.

12. The method of printing by using the scanning printing apparatus according to claim 7, wherein:

printing of the row image being printed is stopped when the detected position of the predetermined invisible marks is outside of a predetermined range in printing each row image.

* * * * *